US009038544B2

(12) United States Patent
Coffin

(10) Patent No.: US 9,038,544 B2
(45) Date of Patent: May 26, 2015

(54) TILT APPARATUS AND KNEEBOARD, LAP TABLE, OR ELECTRONIC DEVICE USING SUCH

(71) Applicant: Braden Coffin, Colorado Springs, CO (US)

(72) Inventor: Braden Coffin, Colorado Springs, CO (US)

( * ) Notice: Subject to any disclaimer, the term of this patent is extended or adjusted under 35 U.S.C. 154(b) by 77 days.

(21) Appl. No.: 13/970,597

(22) Filed: Aug. 20, 2013

(65) Prior Publication Data

US 2015/0053120 A1 Feb. 26, 2015

(51) Int. Cl.
*A47B 23/00* (2006.01)
*A47B 23/06* (2006.01)

(52) U.S. Cl.
CPC ..... *A47B 23/002* (2013.01); *A47B 23/06* (2013.01)

(58) Field of Classification Search
CPC ..... A47B 23/002; A47G 23/0608
USPC ..... 108/1, 3, 4, 6–8; 224/270, 242, 929, 224/930, 901.2, 901.8; 248/455, 460, 441.1
See application file for complete search history.

(56) References Cited

U.S. PATENT DOCUMENTS

| | | | | | |
|---|---|---|---|---|---|
| 2,420,673 | A * | 5/1947 | Monrad | 40/446 |
| 3,791,314 | A * | 2/1974 | Berretta | 108/43 |
| 4,034,947 | A * | 7/1977 | Geisel | 248/349.1 |
| 4,577,788 | A * | 3/1986 | Richardson | 224/483 |
| 4,664,039 | A * | 5/1987 | Schneider | 108/6 |
| 4,762,258 | A * | 8/1988 | Murphy | 224/553 |
| 5,105,338 | A * | 4/1992 | Held | 361/679.09 |
| 5,366,070 | A * | 11/1994 | Wolov | 206/214 |
| 5,537,793 | A * | 7/1996 | Murasaki | 52/585.1 |
| 5,607,091 | A * | 3/1997 | Musacchia | 224/222 |
| 5,639,004 | A * | 6/1997 | Carlton et al. | 224/579 |
| 5,713,548 | A * | 2/1998 | Boyer et al. | 248/205.2 |
| 5,762,250 | A * | 6/1998 | Carlton et al. | 224/579 |
| 5,819,344 | A * | 10/1998 | Otts | 5/603 |
| 6,435,466 | B1 * | 8/2002 | Adams | 248/455 |
| 6,926,244 | B1 * | 8/2005 | O'Neill | 248/346.01 |
| 7,048,243 | B1 * | 5/2006 | Steinman | 248/346.01 |
| 7,481,409 | B1 * | 1/2009 | Reynolds | 248/441.1 |
| 7,980,526 | B2 * | 7/2011 | Lord et al. | 248/444 |
| 8,038,114 | B2 * | 10/2011 | Ting | 248/346.01 |
| 8,328,056 | B2 * | 12/2012 | Berdych | 224/222 |
| 2006/0113342 | A1 * | 6/2006 | Hampton et al. | 224/409 |
| 2008/0006749 | A1 * | 1/2008 | Ferritto | 248/188.6 |
| 2009/0178592 | A1 * | 7/2009 | Hu | 108/6 |
| 2010/0219320 | A1 * | 9/2010 | Knych | 248/440.1 |

* cited by examiner

*Primary Examiner* — Janet M Wilkens
(74) *Attorney, Agent, or Firm* — J. Adele Plotkin

(57) ABSTRACT

A tiltable support apparatus (tilt device) for variably adjusting the height of any one of the four sides of a portable table that is optionally with an electronic device or as a pilot's kneeboard. The tilt mechanism is a flat, flexible layer that can be rolled into a rolled elevating device. An attachment system releasably attaches the tilt mechanism to the adjacent structures such as parts of the table, of an electronic device case, or of a thigh/lap attachment for a kneeboard. The attachment system further allows for attachment with variable increments of tilt possible. In one embodiment, the tiltable support apparatus is a multilayer device containing the flat, flexible layer as a middle layer securely but reversibly attached to upper and lower layers of a case. The case is easily insertable under an object to be tilted and easily stored when not in use.

20 Claims, 4 Drawing Sheets

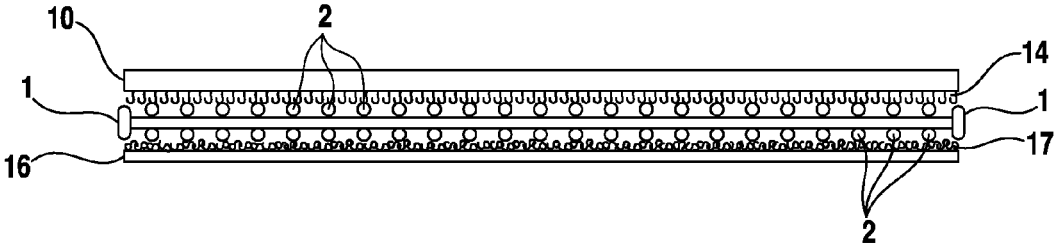
FIG. 4
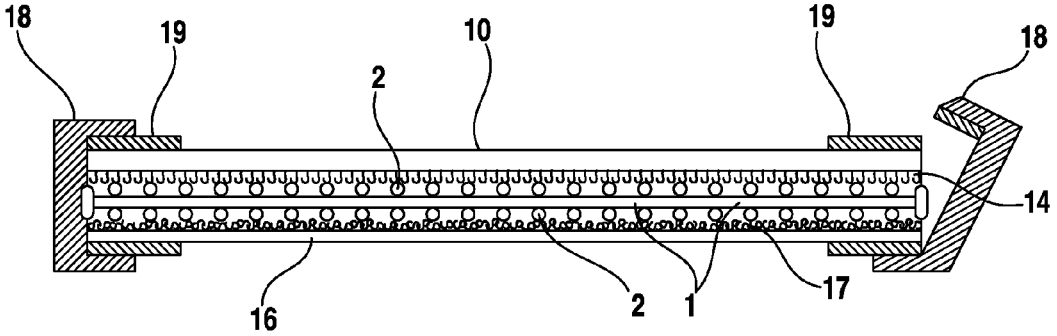
FIG. 5
FIG. 6
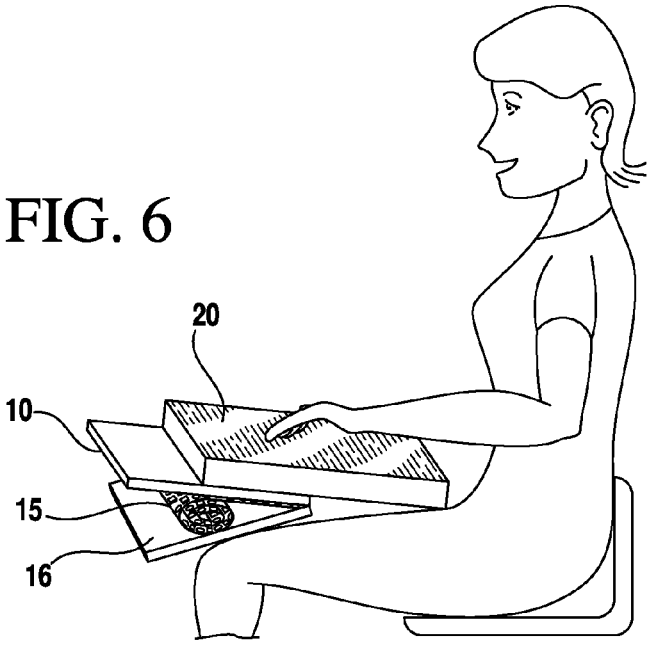

TILT APPARATUS AND KNEEBOARD, LAP TABLE, OR ELECTRONIC DEVICE USING SUCH

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A SEQUENCE LISTING, A TABLE, OR A COMPUTER PROGRAM LISTING COMPACT DISC APPENDIX

Not applicable

BACKGROUND OF THE INVENTION

When people use body supported electronic equipment or writing pads, often times it is difficult to easily view the display screen or pads. Even mobile display screens on flat surfaces can pose difficult viewing depending on the height of the person and the location of where the person is sitting relative to the display screen. Given this, several ways have been suggested for rotating or otherwise adjusting the screen for better viewing.

Further, as a result, many inventive ways to adjust the height, the left/right tilt and the vertical tilt of the display screen have been suggested. However, only Carleton et al. in U.S. Pat. No. 5,762,250 and U.S. Pat. No. 5,639,004 suggest the use of a rolled up piece of material as a tilt mechanism for a lap resting case secured by shoulder straps to a person. The piece of material comes from a releasable bottom piece or a top cover of the carrying case for an electronic device. Velcro type fastener strips or other fasteners such as buckles or snaps can be used on the edges to keep the roll from slipping. A primary purpose seems to be to cushion the person from damage by the carrying case through varying the cushioning and distancing effects by the tightness of the rolling of the material. The use of an air bladder or inflatable cushion is suggested to increase the size of the roll or the tilt. It is not suggested to use this roll of material with an electronic device resting on a non-portable table nor with a thigh attached kneeboard. Further, the piece of material has no incremental tilt stops nor any given specific construction.

There is on the market a tilt pad sold for use with kneeboards that is effectively a wedge to be manually inserted as wanted. Such a wedge is not particularly secure in placement. The amount of tilt from this wedge depends on how far the wedge is inserted beneath the electronic device support or writing pad support.

Hence there is a need for a more reliable tilt mechanism to provide variable elevation along any side of a portable electronic device or portable lap table. The present inventive tilt mechanism provides such improved reliability.

Further there is a need for a more reliable tilt mechanism to provide variable elevation along any side of an electronic device supported as part of a kneeboard. The present inventive tilt mechanism provides such improved reliability.

When included in a portable IPad or other electronic device carrying case, such a tilt mechanism can provide improved visibility and maneuverability of the data screen when in use as compared to the present state of the art. If such a portable carrying case was convertible into a lap table or a kneeboard, then the carrying case would provide a compact and easily portable resource for the user. It would be convenient for carrying in a backpack or a flight bag. Hence it would meet the additional needs of easy portability and convertibility of an electronic device carrying case containing such a tilt mechanism.

BRIEF DESCRIPTION OF THE INVENTION

The present inventive tilt mechanism (tiltable support apparatus) is a flat flexible layer for rolling to form a rolled elevating device able to variably elevate any one of said four sides of a supported lap table, kneeboard, or electronic device. This flexible layer has attachment material such as felt, Velcro or similar material upon one or both sides of the layer that may be in a 'waffle' or checkerboard type configuration. The attachment material allows for secure but reversible attachment of the flexible layer as well as the rolled elevating device to adjacent structures. There are also embodiments in which the rolled elevating device can attach to itself to more securely maintain a specific increment of tilt or elevation desired.

Another embodiment of the present inventive tilt mechanism is a multi-layer case with at least three layers. The outer layers are of leather or other resilient material. The outer layers have a Velcro or a hook-and-loop material or similar type of material as a covering or as a securely attached portion upon at least part of their inner surfaces for use to reversibly connect with the central layer or with the rolled elevating device formed by rolling the central layer to achieve a desired degree of tilt. The central layer has material easily attachable to the inner surfaces of the multi-layer case such as felt, Velcro or similar material upon both sides of the central layer. This attachable material may be in a 'waffle' or checkerboard type configuration. As noted above, the central layer also can be rolled to form a rolled elevating device able to variably elevate any one of said four sides of a supported lap table, kneeboard, or electronic device.

The inventive case may be contained within an I-pad carrying case or other electronic device case just below the position for the device. Optionally, it may be secured in place with Velcro, elastic bands, or other types of securing means known in the art.

In another embodiment, the central layer has regularly spaced raised pieces along the plane defined by the x and y axes and on both sides of the layer. The raised pieces may be of any convenient shape, such as circular or square, that effectively attaches to adjacent structures and/or to other parts of the central layer. When rolled left/right or from/to a person, such a layer provides a variable tilt mechanism which can be locked into place by the Velcro or similar material present on the inner sides of the adjacent outer layers. One embodiment has a hook and loop fastener system with the raised pieces on one side of the central layer being of hook and loop material and the raised pieces on the other side being of the complementary mating hook and loop material. Another embodiment has each side with both the hook and loop material in some of the raised pieces and the complementary mating hook and loop material in others of the raised pieces. This combination is set in a pattern effective to efficiently meet the attachment needs. An additional embodiment has such a combination pattern only on one side of the central layer. When rolled to form a rolled elevating device, the raised pieces are preferably on the outside of the roll to allow for attachment to adjacent structures.

BRIEF DESCRIPTION OF THE FIGURES

FIG. 4 is a side view of the flat flexible layer with attachment means to adjacent structures that have mating attachment means.

FIG. 5 is an embodiment of an exploded side view of the closed multi-layer case containing a flat flexible middle layer attached to the adjacent top and bottom layers and a closing mechanism.

FIG. 6 is a view of the multi-layer case tilt device elevating a lap table.

DETAILED DESCRIPTION OF THE INVENTION

Figure 1:
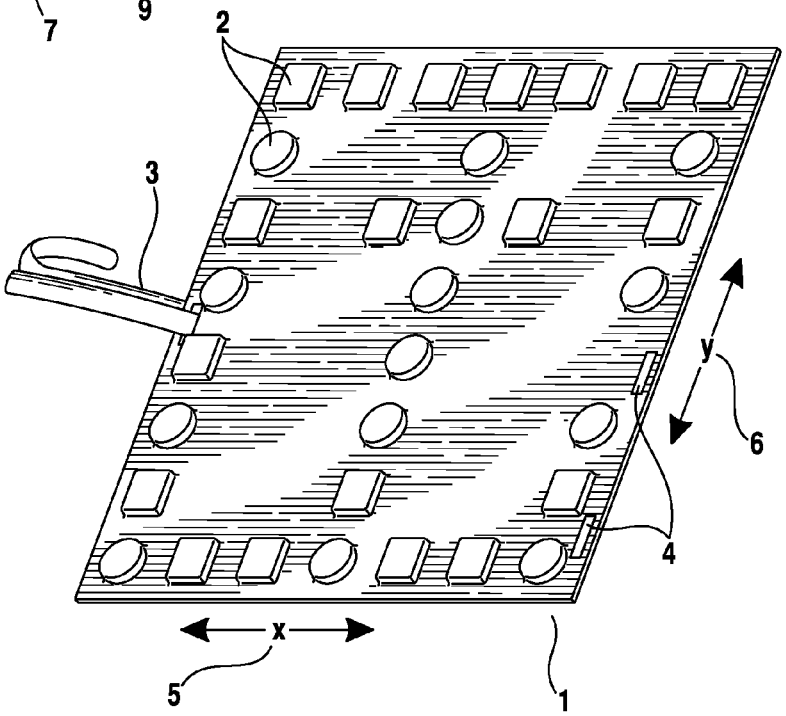
FIG. 1 is a top view of an incomplete flat flexible layer with examples of raised pieces to be regularly spaced throughout the plane defined by the x and y axes of the layer.

As seen in FIG. 1, the present inventive tilt mechanism (tiltable support apparatus) is a flat flexible layer (1) for rolling to form a rolled elevating device able to variably elevate any one of said four sides of a supported lap table, kneeboard, or electronic device. Such a rolled elevating device is seen in FIGS. 3, 6-8, and 10 as element number 15. In FIG. 1, the flexible layer (1) is depicted without being fully filled with raised pieces (2). Instead, examples of possible shapes and positionings are shown. The raised pieces (2) can function as attachment sites using attachment material such as felt, Velcro or similar material upon one or both sides of the layer. They may be in a 'waffle' or checkerboard type configuration. The attachment material allows for secure but reversible attachment of the flexible layer (1) as well as the rolled elevating device (15) to adjacent structures such as 10 and 16 in FIGS. 3-6 and 10. There are also embodiments in which the rolled elevating device (15) can attach to itself to more securely maintain a specific increment of tilt or elevation desired such as could occur in FIGS. 3, 6-8, and 10.

Figure 3:
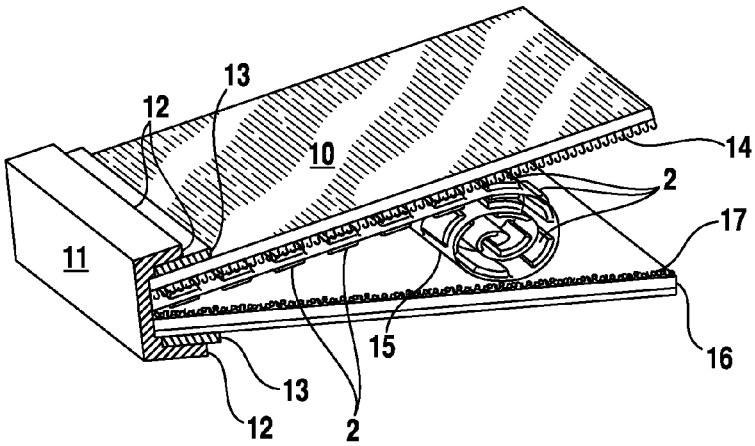
FIG. 3 is one embodiment of a three layer structure including a central layer rolled up to form a rolled elevating device attached reversibly to the two outer layers.

In another embodiment, the central layer (1) has regularly spaced raised pieces (2) along the plane defined by the x (5) and y (6) axes and on both sides of the layer (1). As seen in FIG. 1, the raised pieces (2) may be of any convenient shape, such as circular or square, that effectively attaches to adjacent structures and/or to other parts of the central layer. When rolled right/left, left/right, or from/to a person, such a layer provides a variable tilt mechanism which can be locked into place by the Velcro or similar material (14, 17) present on the inner sides of the outer layers (10, 16) as seen in FIG. 3 (rolled elevating device 15) and FIG. 4 (flat flexible layer 1). One embodiment has a hook and loop fastener system with the raised pieces (2) on one side of the central layer (1) being of hook and loop material and the raised pieces (2) on the other side being of the complementary mating hook and loop material. Another embodiment has each side with both the hook and loop material in some of the raised pieces (2) and the complementary mating hook and loop material in others of the raised pieces (2). This combination is set in a pattern effective to efficiently meet the attachment needs. An additional embodiment has such a combination pattern only on one side of the central layer. When rolled to form a rolled elevating device (15), the raised pieces (2) are preferably on the outside of the roll to allow for attachment to adjacent structures.

Figure 2:
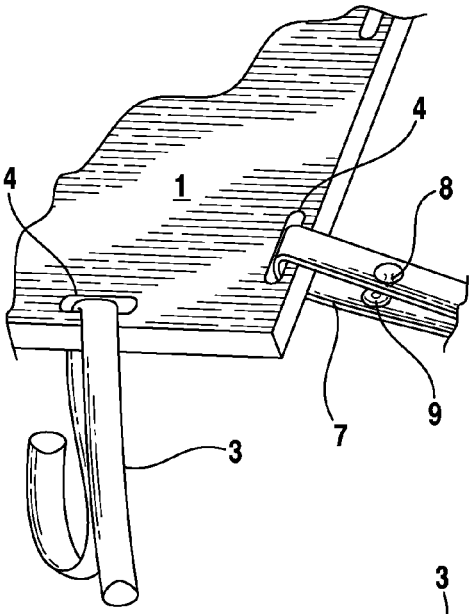
FIG. 2 shows self-attaching strap attachments attached to recesses along the edges of the flat flexible layer. Both snap and Velcro straps are depicted.

Also depicted in FIG. 1 are recesses (4) along the edges of the flexible layer (1) to which can be attached self-interacting securing strap(s) (3) such as those with Velcro and complementary attachment areas. This can be seen also in FIG. 2 which depicts a snap strap (7) with complementary snap parts 8 on the upper segment of the strap above the corresponding recess and 9 on the lower portion of the strap coming from beneath the recess. Not depicted are the attachment sites on adjacent structures. Such sites might simply be similar recesses through which the securing straps such as 3 or 7 could be threaded before self-interacting to secure together both the flexible layer and the adjacent structure or structures. There can be any number of recesses located along the edges of the flexible layer as needed and as convenient to securement sites.

Another embodiment of the present inventive tilt mechanism is a multi-layer case with at least three layers (10, 1 if flat or 15 if rolled, 16) as seen in FIGS. 3, 5 and 6. The outer layers (10 and 16) are of leather or other resilient material. The outer layers have Velcro or hook-and-loop or similar type of material as a covering or as a securely attached portion (14 and 17) upon at least part of their inner surfaces for use to reversibly connect with the raised pieces (2) on the central layer (1) or with the raised pieces (2) on the rolled elevating device (15) formed by rolling the central layer (1) to achieve a desired degree of tilt to elevate an electronic device, a lap table, a kneeboard, and other structures supported on the human body or on a permanent table. The central layer is a flexible layer with raised pieces (2) of material easily attachable to the attaching material (14 and 17) of the inner surfaces of the adjacent structures. In this example, it is the multi-layer case as seen in FIG. 5. The pieces (2) are of attaching materials such as felt, Velcro or similar material upon one or both sides of the central layer (1). This attachable material may be in a 'waffle' or checkerboard type configuration. As noted above, the central layer (1) also can be rolled to form a rolled elevating device (15) able to variably elevate any one of said four sides of a supported lap table, kneeboard, or electronic device.

In FIG. 3, a hinge structure (11) is provided to maintain the relative positions of the three layers with respect to each other. In this embodiment, permanent tabs (13) are attached to the outsides of the outer layers 10 and 16. These are constructed of a material that is coactive with complementary material (12) found on the inside of the hinge structure (11). Such materials could be for instance, hook and loop materials. However any materials known in the art that perform the same function could be used. One primary concern is that the bulk of the hinge structure should be minimized for compactness in order to allow ease of storage and transport.

The inventive case may be contained within an I-pad carrying case or other electronic device case just below the position for the device. Optionally, it may be secured in place with Velcro, elastic bands, snaps, a holder, or other types of securing means known in the art.

Further, the inventive case may be securely closed by means known in the art such as a zipper means, a magnetic means, a Velcro means, elastic bands, a hook-and-loop type material means, a snap strap means, and combinations thereof. FIG. 5 depicts one possible closure method using hook and loop type material (for example, Velcro). Material 19 is permanently attached to the outsides of the outer layers along at least part of the edges of the four sides of each layer. Releasably securing material 18, capable of co-acting with material 19, is then secured to material 19 to reversibly close the case. Material 18 can be in the form of hinges or clip-like structures.

FIG. 6 depicts the use of such a multilayer case to elevate a lap table (20). If desired, the bottom of the lap table (20) could have some areas that could attach to the top of the case upper layer (10). For example, snaps and/or hook and loop materials could be used.

Figure 7:
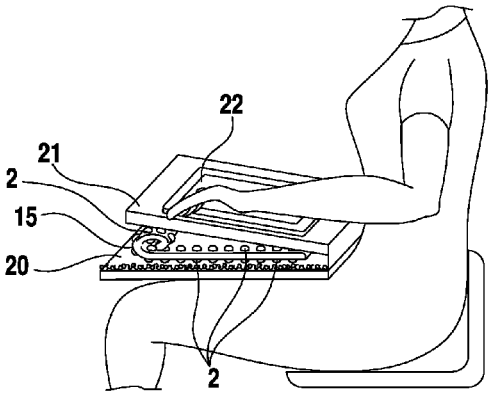
FIG. 7 is a view of the rolled elevating device elevating an electronic device supported on a lap table.

Similarly, the rolled elevating device (15) could be used alone without a case to elevate an electronic device, a lap table, a kneeboard, and other structures supported on the human body or on a permanent table. This is depicted in FIG. 7. The rolled elevating device (15) is resting on a lap table (20) and elevating the holder (21) for an electronic device (22) such as an IPad. The structures adjacent to the rolled elevating device (15) are the lap table (20) and the electronic device holder (21). In one embodiment, although not depicted, the top of the lap table and the bottom of the holder could have segments of material interactive with the raised pieces on the flexible sheet (2) of the rolled elevating device (15) to reversibly secure the rolled elevating device (15) into a desired position for optimal viewing and manipulation.

Figure 8:
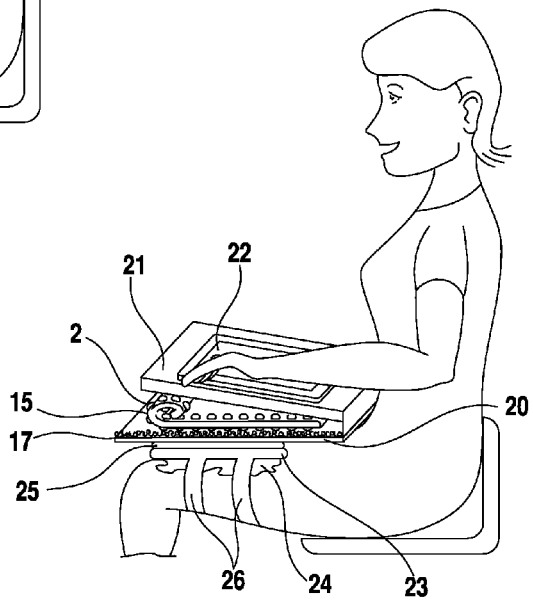
FIG. 8 is a view of the rolled elevating device elevating an electronic device in a convertible carrying case supported as a kneeboard. The thigh straps in this view have extra cushioning for leg comfort.
Figure 9:
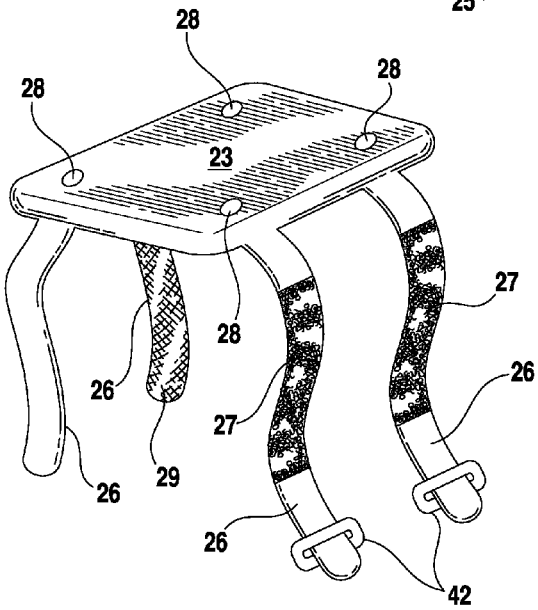
FIG. 9 is a more detailed view of the thigh strap apparatus that attaches to the convertible carrying case supported as a kneeboard or other kind of kneeboard.

Another use of the rolled elevating device (15) is seen in FIG. 8. It is a more secure lap arrangement using a kneeboard support (23) attached to the lap table (20) through an attachment layer (25) such as one of Velcro. The attachment layer may be of snaps, Velcro, or any other means effective for such reversible attachment. FIG. 9 shows a kneeboard support (23) that uses snaps (28) for attachment. The kneeboard in FIG. 8 is further attached to the user's thigh with two straps (26) of non-skid material. For comfort, padding (24) is included between the thigh of the user and the kneeboard support (23). Rolled elevating device (15) is stabilized on lap table (20) by interactive reversible attachment of the raised pieces (2) on the rolled elevating device (15) to attaching material (17) on the upper side of the lap table (20).

More detail of the reversibly attachable kneeboard support structure can be seen in FIG. 9. In this embodiment, rings 42 are provided for helping the alignment of the strap (26) parts around the thigh. The undersides of the straps may be, at least in part, of a first material (29) with the upper sides of a second material (27) co-active with the first material to securely hold the kneeboard support on the lap of the user. Such materials are known in the art and include hook and loop materials, snaps, and so on. Other equivalent means to attach to the thigh of the user can also be used. When the lap table or lapboard is not being used as a kneeboard, the kneeboard support structure can be easily stowed in a pilot's flight bag, backpack, or other small portable container.

Figure 10:
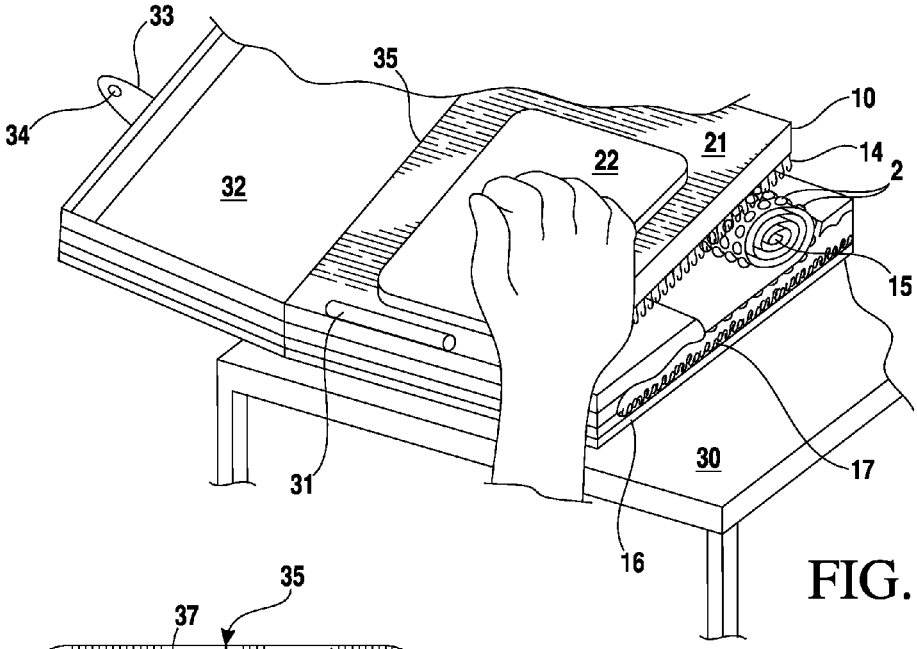
FIG. 10 depicts the combination of the electronic device, the convertible carrying case for the electronic device, and one embodiment of the tilt mechanism when used on a non-portable table.

As noted above, the rolled elevating device (15) can be used with or without the multilayer case configuration to elevate or tilt a device resting on a non-portable table. For purposes of this invention, folding tables are considered non-portable. Tables considered portable are ones that can be transported easily in small luggage, backpacks, briefcases, and the like. FIG. 10 depicts such a use for the rolled elevating device (15). The case for an electronic device (22) such as an IPad is opened at hinge (35) on a non-portable table (30). The electronic device (22) is supported in holder (21). The lower part of the holder (21) acts as the adjacent structure (10) to the rolled elevating device (15). This adjacent structure (10) has attachment material (14) on it that can reversibly attach to the raised pieces (2) on the rolled elevating device (15).

The slightly exploded view of the inside side of the case for the electronic device shows a similar arrangement inside the case for attachment from below to the raised pieces (2) of the rolled elevating device (15). The adjacent structure (16) adjacent to the lower part of the rolled elevating device (15) is the inside of the case. Attachment material (17) is present on at least part of adjacent structure (16) in order to attach reversibly to the raised pieces (2) of the rolled elevating device (15) and thereby secure the rolled elevating device (15) in a position with optimally desired tilt.

The case for the electronic device is depicted with a means to close the case (33). In this embodiment, the means (33) is a tab with a snap or magnetic closure (34). There are many means with which closure can be achieved as is well known in the art and hence encompassed within this invention. Additionally, it is often desired to use other accoutrements while working with an electronic device. Hence attachments for writing implements, paper, pads, maps, etc. are often included in the case structure for electronic devices. One such example in FIG. 10 is the holder (31) for a writing implement such as a pen or pencil.

Figure 11:
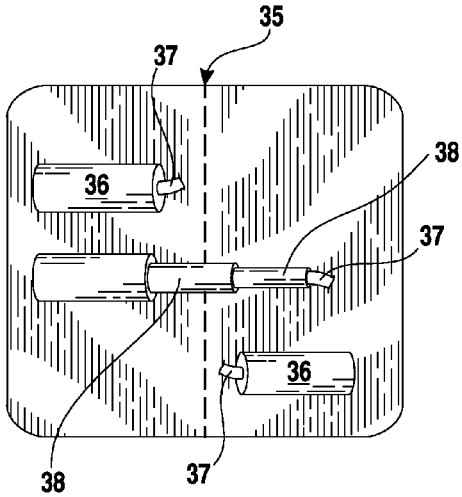
FIG. 11 is a bottom view of the open carrying case for the electronic device showing telescoping stiffeners used to stabilize the carrying case to function as a lap table with two panels.

If the case for an electronic device is intended for use as a lap table when open, the underside of the case may be provided with one or more stiffeners so that the panels of the lap board will not droop. One type of stiffeners is depicted in FIG. 11. The bottoms of the two panels made by opening the case can be seen on either side of the case hinge (35). On them are three stiffeners (36). They have pull tabs (37) which can be used to extend the telescoping stiffener segments (38) to the extent desired. Many types of stiffeners are known to the art. They can be used in multiple configurations chosen to best suit the stiffening needs of any particular case to be used as a lap table.

Figure 12:
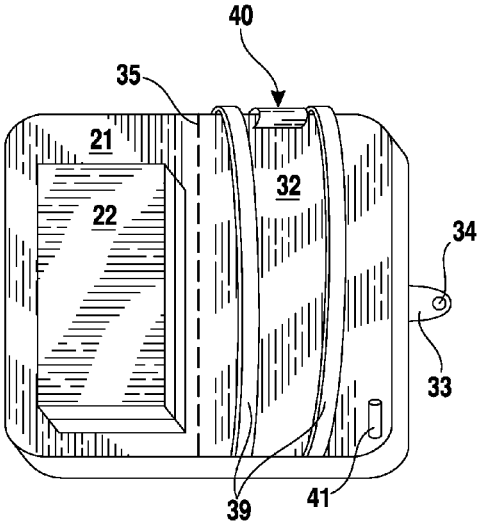
FIG. 12 is a top view of the open carrying case in use as a two panel lap table with supports for the electronic device, writing materials, and other useful items.

An example of a case for an electronic device being open and used as a lap table supporting the electronic device is depicted in FIG. 12. The lap table top of the open case is seen from above in this view. On either side of the case hinge (35) there is a panel. On one side, the panel acts as holder 21 supporting electronic device 22. Although not visible in this view, the inventive tilt mechanism described herein can be located underneath electronic device (22). The rolled elevating device can be with or without the layered case in either the three layer or the single layer embodiments. On the other side, panel 32 can be used to support multiple useful items. For instance, a writing implement could be inserted into holder 41. Plastic clip 40 and elastic bands 39 can further hold writing pads, paper, navigation maps, charts, forms, and other useful items. In a non-depicted embodiment, additional panels of similar or smaller size might be folded out or swiveled out from the existing panels to enlarge the work area available. The panel surfaces may be decorated in any motif desired. A child's electronic device might have a toy motif on the case or panels. An electronic device for a pilot could be decorated with an aviation motif. In FIG. 12, the case for the electronic device is depicted with a means to close the case (33). In this embodiment, the means is a tab (33) with a snap or magnetic closure (34).

The spacing of the raised pieces on the flexible layer helps determine how many levels of tilt are available for use in any direction of roll. The closer the spacing, the more levels of possible tilt are available. While homogeneous attachable surfaces could be used, using raised pieces has several advantages. It is easier to prevent slippage and unintentional tilt changes when using raised pieces for attachment rather than a continuous attachment surface. Further the weight of the device is reduced when raised pieces are used instead of a continuous attachment surface. Unlike the homogenous character of a continuous attachment surface, the raised pieces may be a mixture of attachment character such as a mixture of alternating hook pieces with loop pieces. This would allow attachment to a greater variety of surfaces.

The number of raised pieces and their spacing on the flexible layer may be determined for a given product by the intended end use. Use with a kneeboard would likely have a lower maximum desired tilt than would use with an electronic device on a non-portable table where users might want a nearly vertical screen. Height of the user and distance from the lap table or electronic device would also be a factor in determining the optimal tilt desired. Further different aircraft configurations will cause people to sit differently in the cockpit and hence may also affect the location of attachment to the thigh and the amount of tilt desired for optimal viewing and manipulation of the items supported on a kneeboard. Kneeboard viewing has primary concerns of reducing or eliminating glare on supported devices, of maintaining a position for the devices that will not interfere with yoke and other control instrument usage, and will be visible despite any items in the craft that may reduce the field of vision. The adjacent surfaces might also have patterns of raised pieces for similar reasons. Alternatively, the rolled tilt device/flexible layer could have a continuous layer of attachable material while the adjacent surfaces would have the tilt level determining pattern of raised pieces.

In the preceding detailed description, reference has been made to the accompanying figures which illustrate specific embodiments of the presented invention. These embodiments and variants thereof have been described in sufficient detail to enable those skilled in the art to practice the described invention. As would be evident to those skilled in the art, the preceding detailed description is not limited to the specifics of the embodiments described but rather is intended to cover such alternatives, modifications, and equivalents as can reasonably be included within the spirit and scope of the described invention and the appended claims.

That which is claimed is:

1. A tiltable support apparatus, for a portable electronic device having four sides and a top and a bottom, comprising a square or rectangular shaped case comprising a. a top layer with a top inside and a top outside, b. a bottom layer with a bottom inside and a bottom outside, c. a flexible middle layer for rolling to form a rolled elevating device able to variably elevate any one of said four sides, and d. a means to close said case securely wherein said flexible middle layer has a middle top side and a middle bottom side and is held securely in place by a first attachment means between said top inside and said middle top side and by a second attachment means between said bottom inside and said middle bottom side and wherein said flexible middle layer is held securely held in place by said first and second attachment means both when said flexible middle layer is flat or when said flexible middle layer is used as a rolled elevating device.

2. A tiltable support apparatus as described in claim 1 wherein said flexible middle layer has an x axis direction and a y axis direction and regularly spaced raised pieces along both said middle top side and said middle bottom side throughout the plane defined by said x axis direction and said y axis direction, wherein said raised pieces can attach to said first attachment means when in contact with said first attachment means and wherein said raised pieces can attach to said second attachment means when in contact with said second attachment means.

3. A tiltable support apparatus as described in claim 2 wherein said raised pieces have a functional shape optionally selected from a circular shape, a square shape, or a combination of functional shapes.

4. A tiltable support apparatus as described in claim 3 wherein said raised pieces are selected from felt or hook-and-loop type material or other co-acting type of material and wherein said first attachment means and said second attachment means are of any material attachable to said raised pieces.

5. A tiltable support apparatus as described in claim 2 wherein said first attachment means is a securely attached layer or covering of hook-and-loop type material or other co-acting type of material on said top inside and said second attachment means is a securely attached layer or covering of felt or hook-and-loop or other co-acting type of material on said bottom inside and wherein said raised pieces can attach to said first attachment means when in contact with said first attachment means and wherein said raised pieces can attach to said second attachment means when in contact with said second attachment means.

6. A tiltable support apparatus as described in claim 1 wherein said flexible middle layer has edges which have one or more recesses for the attachment of one or more removable self-attaching straps wherein said straps are part of a means of additional securement for said flexible middle layer.

7. A tiltable support apparatus as described in claim 1 wherein said means to close said case securely is selected from the group of a zipper means, a magnetic means, elastic bands, a hook-and-loop type material means, a snap strap means, and combinations thereof.

8. A tiltable support apparatus as described in claim 1 in combination with a portable electronic device convertible carrying case comprising a. A case outside and a case inside when said carrying case is in closed position, b. A working lap table with a first panel with outer edges and a second panel with outside edges formed from said case inside when said carrying case is in open position wherein said first panel provides support for said electronic device, c. A secure closing means for said carrying case when in said closed position, d. A means to releasably secure said electronic device onto said tiltable support apparatus, e. A second means to releasably secure said tiltable support apparatus to said working lap table, f. At least one holder attached to said outer edges for writing implements or other items, and g. Attachment means to secure notepads, maps, papers, charts, forms, writing implements, or combinations thereof to said second panel, wherein said means to releasably secure said electronic device allows for release of said electronic device, rotation of said electronic device to a more desirable position, and re-attachment of said electronic device to said working lap table and wherein said tiltable support apparatus can be removed and replaced as needed for adjustment of the height and direction of said rolled elevating device within.

9. A combination as described in claim 8 wherein said secure closing means is selected from the group of a zipper means, a magnetic means, elastic bands, a hook-and-loop type material means, a snap strap means, and combinations thereof.

10. A combination as described in claim 8 wherein said means to releasably secure said electronic device is selected from hook-and-loop material, and other types of co-acting materials.

11. A combination as described in claim 8 wherein said second means to releasably secure said electronic device is selected from hook-and-loop material, and other types of co-acting materials.

12. A combination as described in claim 8 wherein said attachment means to secure is selected from the group of a magnetic means, elastic bands, a hook-and-loop type material means, a snap strap means, and combinations thereof.

13. A combination as described in claim 8 wherein when said tiltable support apparatus is not in use said means to releasably secure said electronic device can secure said electronic device to said working lap table.

14. A combination as described in claim 8 further comprising at least one stiffener tab placed under one or both of said first panel and said second panel and attached to said case outside.

15. A combination as described in claim 8 further comprising two straps attached to a central wide band of material having a lower side and an upper side and further having a means to releasably attach to said carrying case outside wherein said two straps are of non-skid material that can self-connect after being wrapped around a thigh.

16. A combination as described in claim 15 wherein said means to releasably attach to said carrying case outside is selected from snaps, hook-and-loop material, and other types of co-acting materials.

17. A combination as described in claim 15 wherein said non-skid material that can self-connect is a corduroy-like material with sections of connecting material selected from hook-and-loop material and other types of co-acting materials.

18. A combination as described in claim 15 further comprising at least one elastic writing implement holder on said central wide band.

19. A combination as described in claim 15 wherein each of said two straps has an upper side and a thigh contacting lower side and wherein said combination further comprises additional padding on at least part of said lower side of said central wide band of material and said thigh contacting lower side of each of said two straps.

20. A tiltable support apparatus comprising a flat flexible layer wherein said flat flexible layer is a rolled elevating device to elevate an adjacent surface when said flat flexible layer is rolled to form said rolled elevating device;

wherein said flat flexible layer has a top side and a bottom side, has an x axis direction and a y axis direction defining a plane along said top side and said bottom side, and has regularly spaced raised pieces along both said top side and said bottom side throughout said plane;

wherein said raised pieces form sites for attachment to other sites on said flat flexible layer when said flat flexible layer is rolled to form said rolled elevating device;

wherein said raised pieces form sites for attachment to adjacent sites on adjacent surfaces;

wherein said flat flexible layer is releasably secured in place by an attachment system comprising a top side attachment means and a bottom side attachment means when co-acting attachment means are available on said adjacent surfaces;

wherein said flat flexible layer is held securely held in place by said attachment system when said flat flexible layer is flat or when said flat flexible layer is used as said rolled elevating device.

* * * * *